US009896947B2

(12) United States Patent
Lana

(10) Patent No.: US 9,896,947 B2
(45) Date of Patent: Feb. 20, 2018

(54) TURBINE AIRFOIL ATTACHMENT WITH MULTI-RADIAL SERRATION PROFILE

(71) Applicant: United Technologies Corporation, Hartford, CT (US)

(72) Inventor: Kyle Lana, Portland, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 307 days.

(21) Appl. No.: 14/853,506

(22) Filed: Sep. 14, 2015

(65) Prior Publication Data

US 2016/0169011 A1 Jun. 16, 2016

Related U.S. Application Data

(60) Provisional application No. 62/092,038, filed on Dec. 15, 2014.

(51) Int. Cl.
*F01D 5/30* (2006.01)

(52) U.S. Cl.
CPC ..... *F01D 5/3007* (2013.01)

(58) Field of Classification Search
CPC ..... F01D 5/3007; F01D 5/3015; F01D 5/323; F01D 5/326
USPC ..... 416/219 R, 220 R, 221, 239, 248
See application file for complete search history.

(56) References Cited

U.S. PATENT DOCUMENTS 4,260,331 A * 4/1981 Goodwin ..... F01D 5/3007 416/219 R
8,079,817 B2 * 12/2011 Lagrange ..... F01D 5/3007 416/219 R
2015/0098832 A1 * 4/2015 Carter ..... F01D 5/147 416/223 R

* cited by examiner

*Primary Examiner* — Christopher Verdier
(74) *Attorney, Agent, or Firm* — Snell & Wilmer, L.L.P.

(57) ABSTRACT

An attachment root of an airfoil is provided comprising a serration profile with a symmetry plane bisecting the serration profile. A first lobe of the serration profile has a first contact face angled 45 degrees from the symmetry plane. A second lobe of the serration profile has a second contact face angled 45 degrees from the symmetry plane. The first contact face may have a shorter length than the second contact face.

13 Claims, 3 Drawing Sheets

TURBINE AIRFOIL ATTACHMENT WITH MULTI-RADIAL SERRATION PROFILE

CROSS-REFERENCE TO RELATED APPLICATIONS

This application is a nonprovisional of, and claims priority to, and the benefit of U.S. Provisional Application No. 62/092,038, entitled "TURBINE AIRFOIL ATTACHMENT WITH MULTI-RADIAL SERRATION PROFILE," filed on Dec. 15, 2014, which is hereby incorporated by reference in its entirety.

FIELD OF INVENTION

The present disclosure relates to gas turbine engines, and, more specifically, to an airfoil attachment for rotating airfoils in a gas turbine engine.

BACKGROUND

Airfoils that rotate in gas turbine engines may generally be attached to rotor disks. The rotor disks in turbine sections and compressor sections of a gas turbine engine may rotate at high angular velocities. The resulting centripetal force may place stress on contact points where the airfoil is connected to the rotor. The high stress levels combined with high temperatures may accelerate wear and tear on the airfoil.

SUMMARY

An attachment root of an airfoil is provided comprising a serration profile with a symmetry plane bisecting the serration profile. A first lobe of the serration profile has a first contact face angled 45 degrees from the symmetry plane. A second lobe of the serration profile has a second contact face angled 45 degrees from the symmetry plane. The first contact face may have a shorter length than the second contact face.

In various embodiments, the first lobe may comprise a first segment having a first radius of 0.055 to 0.065 inches. A second segment may follow the first segment and have a second radius of 0.115 to 0.125 inches. A third segment may follow the second segment with a third radius of 0.105 to 0.115 inches. The first contact face may follow the third segment with a fourth segment following the first contact face. The fourth segment may have a fourth radius of 0.055 to 0.065 inches. A fifth segment following the fourth segment and may have a fifth radius of 0.188 to 0.198 inches. A sixth segment may follow the fifth segment with a radius of 0.045 to 0.055 inches. A seventh segment may follow the sixth segment with a radius of 0.041 to 0.051 inches.

In various embodiments, the second lobe may comprise an eighth segment following the seventh segment and having a radius of 0.115 to 0.125 inches. The proximal contact face may follow the eighth segment. A ninth segment following the proximal contact face may have a radius of 0.038 to 0.048 inches. A tenth segment may follow the ninth segment with a radius of 0.100 to 0.110 inches.

In various embodiments, the first segment may be tangentially continuous with the second segment and the second segment may be tangentially continuous with the third segment. The serration profile may be tangentially continuous from the first segment to the tenth segment. The attachment root may also be symmetric about the symmetry plane.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the exemplary embodiments of the disclosure, it should be understood that other embodiments may be realized and that logical changes and adaptations in design and construction may be made in accordance with this disclosure and the teachings herein. Thus, the detailed description herein is presented for purposes of illustration only and not limitation. The scope of the disclosure is defined by the appended claims. For example, the steps recited in any of the method or process descriptions may be executed in any order and are not necessarily limited to the order presented.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials.

As used herein, "aft" refers to the direction associated with the tail (e.g., the back end) of an aircraft, or generally, to the direction of exhaust of the gas turbine. As used herein, "forward" refers to the direction associated with the nose (e.g., the front end) of an aircraft, or generally, to the direction of flight or motion.

As used herein, "distal" refers to the direction radially outward, or generally, away from the axis of rotation of a turbine engine. As used herein, "proximal" refers to a direction radially inward, or generally, towards the axis of rotation of a turbine engine.

Figure 1:
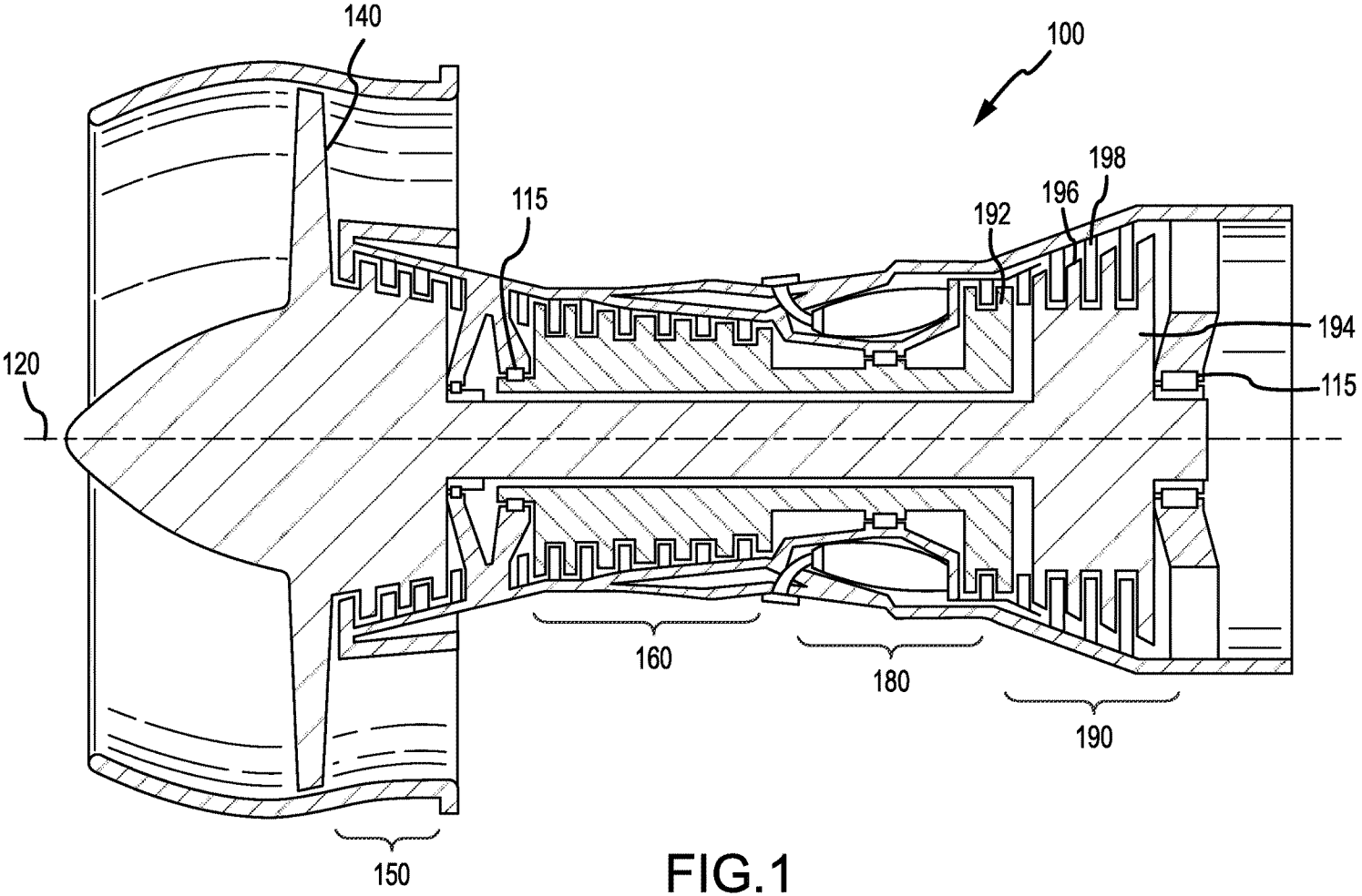
FIG. 1 illustrates a cross-sectional view of an exemplary gas turbine engine, in accordance with various embodiments.

Referring to FIG. 1, a gas turbine engine 100 (such as a turbofan gas turbine engine) is illustrated according to various embodiments. Gas turbine engine 100 is disposed about axial centerline axis 120, which may also be referred to as axis of rotation 120. Gas turbine engine 100 may comprise a fan 140, compressor sections 150 and 160, a combustion section 180, and a turbine section 190. Air compressed in compressor sections 150, 160 may be mixed with fuel and burned in combustion section 180 and expanded across turbine section 190. Turbine section 190 may include high-pressure rotors 192 and low-pressure rotors 194, which rotate in response to the expansion. Turbine section 190 may comprise alternating rows of rotary airfoils or blades 196 and static airfoils or vanes 198. Airfoils 196 may be inserted into high-pressure rotors 192 or low-pressure rotors 194 and retained by a root having a serration profile. A plurality of bearings 115 may support spools in the gas turbine engine 100. FIG. 1 provides a general understanding of the sections in a gas turbine engine, and is not intended to limit the disclosure. The present disclosure may extend to all types of turbine engines, including turbofan gas turbine engines, turbojet engines, and industrial gas turbine engines, for all types of applications.

Figure 2:
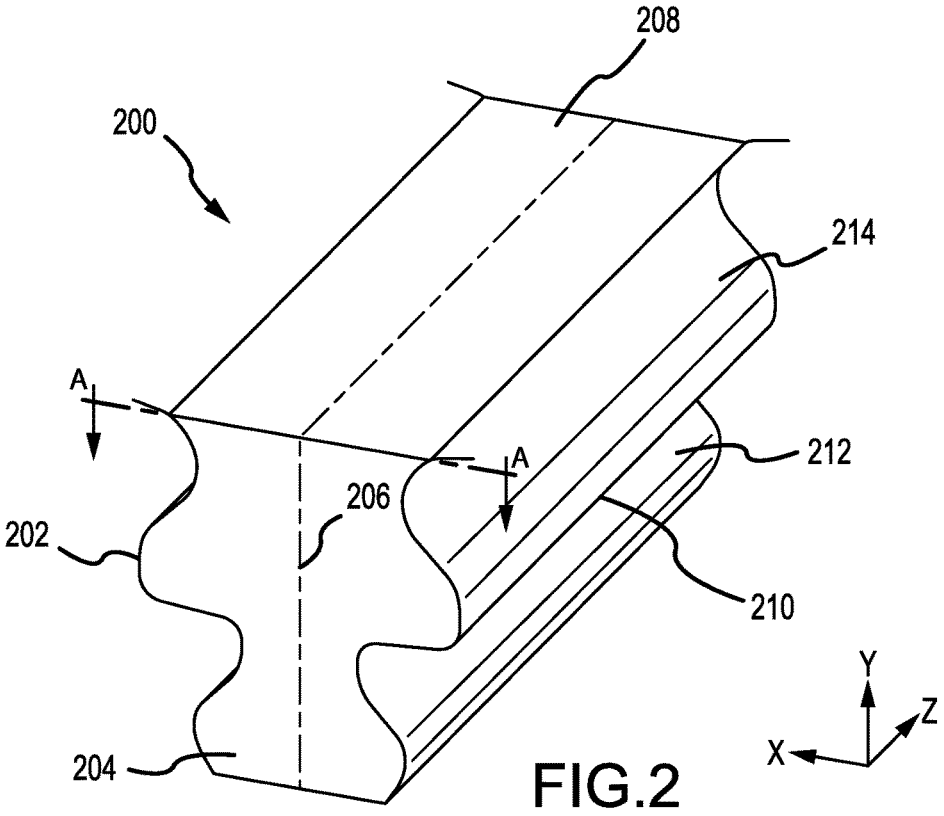
FIG. 2 illustrates a perspective view of an airfoil attachment root, in accordance with various embodiments.

With reference to FIG. 2, an attachment root 200 for an airfoil (e.g., airfoil 196 of FIG. 1) is shown, in accordance with various embodiments. Attachment root 200 comprises a serration profile 202 defining a boundary face 204 having a planar contour. Cross-sectional boundary 208 may be adjacent to boundary face 204 and serve as a radial boundary between attachment root 200 and an airfoil formed integrally to attachment root 200. Cross-sectional boundary 208 may have a planar contour. A symmetry plane 206 may bisect the boundary face 204 and cross-sectional boundary 208. In various embodiments, attachment root 200 may be formed by casting with serration profile 202 further refined by milling, electrochemical machining (ECM), or electrostatic discharge machining (EDM) as desired, for example. In that regard, the attachment root and airfoil may be made from a high performance austenitic nickel alloy (e.g., a nickel alloy available under the trademark INCONEL).

In various embodiments, serration profile 202 may extend in the z direction (as shown in FIG. 2) and define interface surface 210. Interface surface 210 may comprise a proximal contact face 212 and distal contact face 214. Each contact face may be substantially flat in the z direction. Serration profile 202 may be selected to fit into a retention groove formed in a rotor. In that regard, proximal contact face 212 and distal contact face 214 may be configured to contact a rotor and retain attachment root 200 in the rotor while limiting wear during use. Each contact face of interface surface 210 may be separated by a radial or multi-radial portion of interface surface 210. Interface surface 210 may be bilaterally symmetric with respect to symmetry plane 206.

Figure 3:
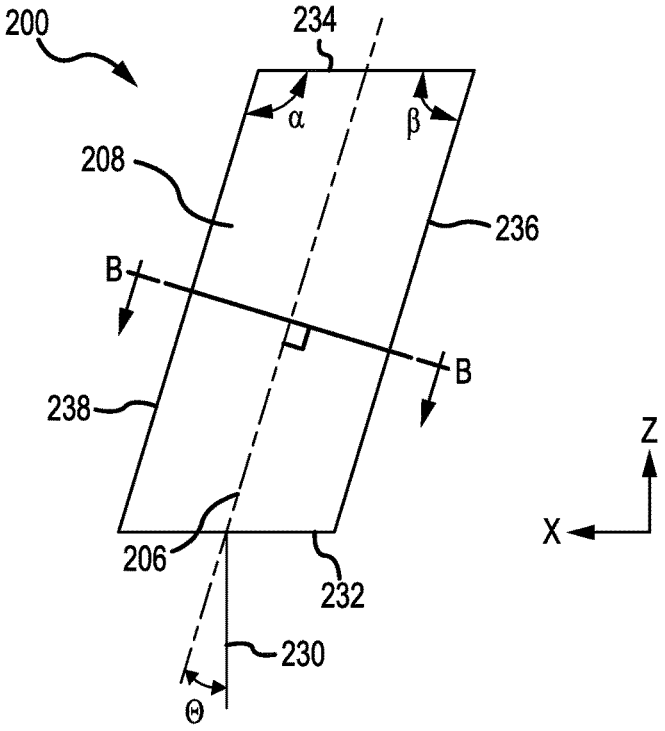
FIG. 3 illustrates a top view of an airfoil attachment root, in accordance with various embodiments.

With reference to FIG. 3, an attachment root 200 is shown in a top view relative to engine center line 230 of a gas turbine engine (e.g., gas turbine engine 100 from FIG. 1), in accordance with various embodiments. Attachment root 200 in FIG. 3 is shown as viewed in the x-z plane (of FIG. 2) passing through line A (of FIG. 2). Attachment root 200 may have an angle θ with respect to engine center line 230. For example, the angle between engine center line 230 and symmetry plane 206 may be approximately 5° when attachment root 200 is installed in a gas turbine engine. Axial boundary 232 and axial boundary 234 of cross-sectional boundary 208 may form a 90° angle with engine center line 230. Similarly, an angle between the axial boundary 234 and boundary 238 may be approximately 95°, and an angle between axial boundary 234 and boundary 236 may be approximately 85°. In that regard, cross-sectional boundary 208 of attachment root 200 may have a parallelogram shape.

Figure 4:
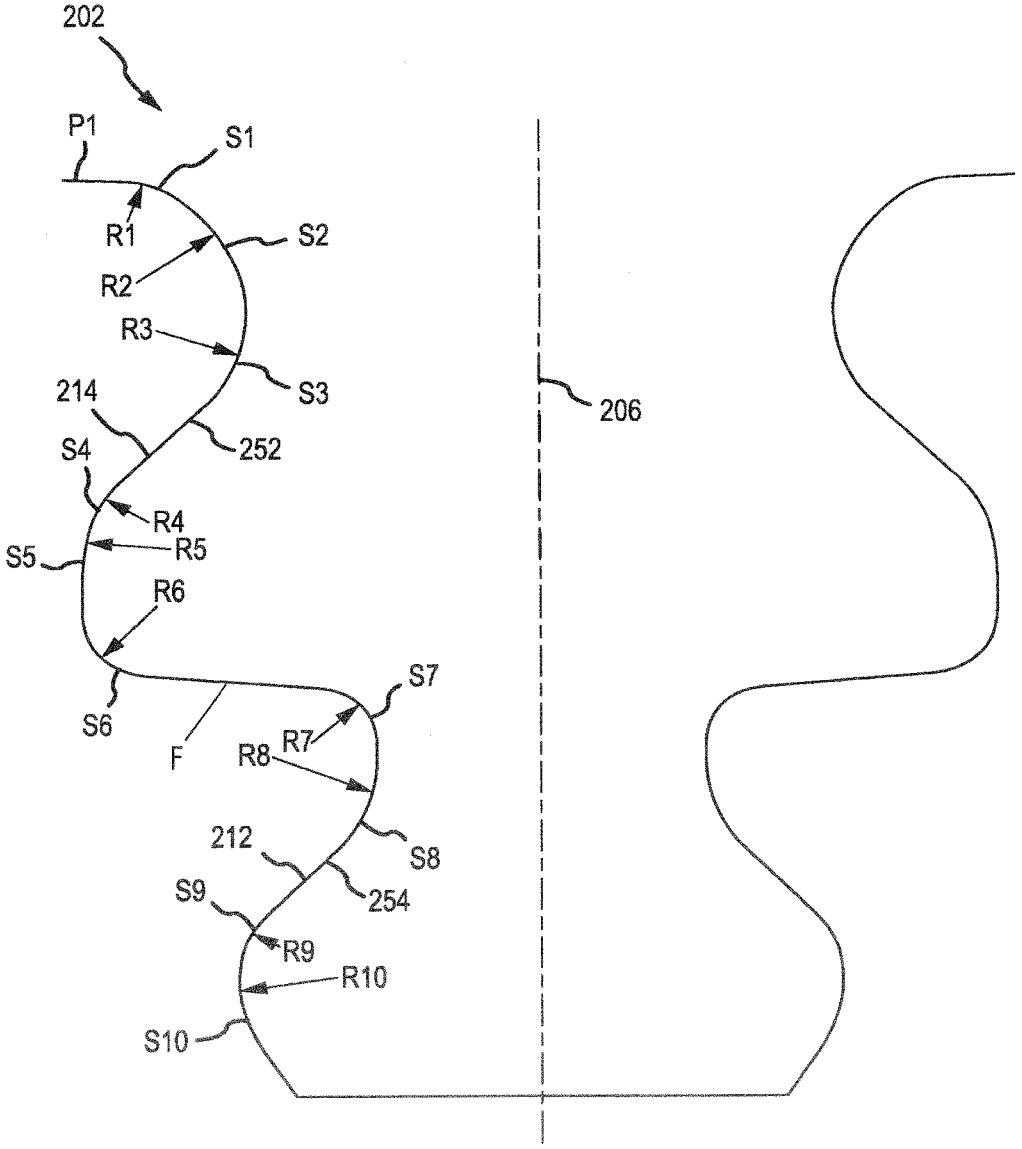
FIG. 4 illustrates the serration profile of an airfoil attachment root, in accordance with various embodiments.

With reference to FIG. 4, a serration profile 202 of an attachment root 200 is shown, in accordance with various embodiments. Serration profile 202 may be the cross-sectional profile of attachment root 200 taken through line B of FIG. 3. As described herein, serration profile 202 may be tangentially continuous between arcs and flat portions with discontinuities noted. Serration profile 202 may include distal contact face 214 and proximal contact face 212 with each defined by a different lobe of serration profile 202. The radii R1-R10 defined herein may vary in a range as provided in table T1.

TABLE T1

Minimums and maximums for Radii R1-R10.

| Radius | Min (inches) | Max (inches) | Min (mm) | Max (mm) |
|---|---|---|---|---|
| R1 | 0.055 | 0.065 | 1.397 | 1.651 |
| R2 | 0.115 | 0.125 | 2.921 | 3.175 |
| R3 | 0.105 | 0.115 | 2.667 | 2.921 |
| R4 | 0.055 | 0.065 | 1.397 | 1.651 |
| R5 | 0.188 | 0.198 | 4.775 | 5.029 |
| R6 | 0.045 | 0.055 | 1.143 | 1.397 |
| R7 | 0.041 | 0.051 | 1.041 | 1.295 |
| R8 | 0.115 | 0.125 | 2.921 | 3.175 |
| R9 | 0.038 | 0.048 | 0.965 | 1.219 |
| R10 | 0.100 | 0.110 | 2.540 | 2.794 |

For example, serration profile 202 may have a distal lobe 252 starting at point P1 with segment S1. Segment S1 may be concave arc with radius R1 of 0.055 to 0.065 inches (1.397 to 1.651 mm). Segment S2 may be a concave arc following segment S1. Segment S2 may have a radius R2 of 0.115 to 0.125 inches (2.921 to 3.175 mm). Segment S3 may be a concave arc following segment S2. Segment S3 may have a radius R3 of 0.105 to 0.115 inches (2.667 to 2.921 mm). Segment S3 may be followed by distal contact face 214. Distal contact face 214 may be a flat segment at substantially 45° relative to symmetry plane 206. Segment S4 may be a convex arc following distal contact face 214. As used herein, substantially may refer to an angle in a +/−2° range. For example, an angle of substantially 45° may be in the range of 43° to 47°. Segment S4 may have a radius R4 of 0.055 to 0.065 inches (1.397 to 1.651 mm). Segment S5 may be a convex arc following segment S4. Segment S5 may have a radius R5 of 0.188 to 0.198 inches (4.775 to 5.029 mm). Segment S6 may have a radius R6 of 0.045 to 0.055 inches (1.143 to 1.397 mm). Segment S7 may be a concave arc following segment S6. Segment S7 may have a radius R7 of 0.041 to 0.051 inches (1.041 to 1.295 mm). A flat segment F at approximately 85° from the symmetry plane may extend between S6 and S7. The end of S7 marks the end of distal lobe 252 and the beginning of proximal lobe 254.

In various embodiments, segment S8 may be a concave arc following segment S7. Segment S8 may have a radius R8 of 0.115 to 0.125 inches (2.921 to 3.175 mm). Proximal contact face 212 may follow segment S8 at an angle of substantially 45° from symmetry plane 206. Proximal contact face 212 may have a shorter length than distal contact face 214. Segment S9 may follow proximal contact face 212. Segment S9 may be a convex arc with radius R9 of 0.038 to 0.048 inches (0.965 to 1.219 mm). Segment S10 may follow segment S9. Segment S10 may be a concave arc having radius R10 of 0.100 to 0.110 inches (2.540 to 2.794 mm). A tangential discontinuity or cusp may follow segment S10 with a segment orthogonal to symmetry plane 206 extending to symmetry plane 206.

In various embodiments, the shape of serration profile 202 may improve the strength and wear characteristics of attachment root 200. The lobes of serration profile 202 may be designed to withstand numerous start-up and shut-down sequences while resisting wear. As a result, turbine blades attached to a rotor by attachment root 200 with serration profile 202 may have a longer functional life before replacement.

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An attachment root of an airfoil, comprising:

a serration profile;

a symmetry plane bisecting the serration profile;

a first lobe of the serration profile with a first contact face angled substantially 45 degrees from the symmetry plane;

a second lobe of the serration profile with a second contact face angled substantially 45 degrees from the symmetry plane, wherein the first lobe comprises a first segment having a first radius of 0.055 to 0.065 inches, a second segment following the first segment having a second radius of 0.115 to 0.125 inches, a third segment following the second segment having a radius of 0.105 to 0.115 inches, and a fourth segment following the first contact face having a fourth radius of 0.055 to 0.065 inches and wherein the first contact face follows the third segment and the first contact face has a shorter length than the second contact face.

2. The attachment root of claim 1, wherein the first lobe comprises a fifth segment following the fourth segment and having a fifth radius of 0.188 to 0.198 inches.

3. The attachment root of claim 2, wherein the first lobe comprises a sixth segment following the fifth segment and having a sixth radius of 0.045 to 0.055 inches.

4. The attachment root of claim 3, wherein the first lobe comprises a seventh segment following the sixth segment and having a seventh radius of 0.041 to 0.051 inches.

5. The attachment root of claim 4, wherein the second lobe comprises an eighth segment following the seventh segment and having an eighth radius of 0.115 to 0.125 inches, wherein the second contact face follows the eighth segment.

6. The attachment root of claim 5, wherein the second lobe comprises a ninth segment following the second contact face and having a ninth radius of 0.038 to 0.048 inches.

7. The attachment root of claim 6, wherein the second lobe comprises a tenth segment following the ninth segment and having a tenth radius of 0.100 to 0.110 inches.

8. An airfoil, comprising:

an attachment root with a profile;

a first lobe of the profile having a first multi-radial contour;

a second lobe of the profile having a second multi-radial contour;

a first contact face on the first lobe;

a second contact face on the second lobe;

a first segment having a first radius of 0.055 to 0.065 inches;

a second segment following the first segment and having a second radius of 0.115 to 0.125 inches;

a third segment following the second segment and having a third radius of 0.105 to 0.115 inches;

the first contact face following the third segment;

a fourth segment following the first contact face and having a fourth radius of 0.055 to 0.065 inches;

a fifth segment following the fourth segment and having a fifth radius of 0.188 to 0.198 inches;

a sixth segment following the fifth segment and having a radius of 0.045 to 0.055 inches; and a seventh segment following the sixth segment and having a seventh radius of 0.041 to 0.051 inches.

9. The airfoil of claim 8, wherein the second lobe comprises:

an eighth segment following the seventh segment and having an eighth radius of 0.115 to 0.125 inches;

the second contact face following the eighth segment;

a ninth segment following the second contact face and having a ninth radius of 0.038 to 0.048 inches; and a tenth segment following the ninth segment and having a tenth radius of 0.100 to 0.110 inches.

10. The airfoil of claim 9, wherein the first contact face is longer than the second contact face.

11. The airfoil of claim 9, wherein the profile is tangentially continuous from the first segment to the tenth segment.

12. A high-pressure turbine, comprising:

a rotor configured to rotate about an axis;

an airfoil coupled to the rotor by an attachment root, wherein the attachment root comprises a serration profile;

a distal lobe of the serration profile having a first multi-radial contour;

a proximal lobe of the serration profile having a second multi-radial contour, wherein the distal lobe is tangentially continuous with the proximal lobe;

wherein the distal lobe comprises a first segment having a first radius of 0.055 to 0.065 inches;

a second segment following the first segment and having a second radius of 0.115 to 0.125 inches;

a third segment following the second segment and having a third radius of 0.105 to 0.115 inches;

a distal contact face following the third segment;

a fourth segment following the distal contact face and having a fourth radius of 0.055 to 0.065 inches;

a fifth segment following the fourth segment and having a fifth radius of 0.188 to 0.198 inches;

a sixth segment following the fifth segment and having a radius of 0.045 to 0.055 inches; and a seventh segment following the sixth segment and having a seventh radius of 0.041 to 0.051 inches.

13. The high-pressure turbine of claim 12, wherein the proximal lobe comprises:

an eighth segment following the seventh segment and having an eighth radius of 0.115 to 0.125 inches;

a proximal contact face following the eighth segment;

a ninth segment following the proximal contact face and having a ninth radius of 0.038 to 0.048 inches; and a tenth segment following the ninth segment and having a tenth radius of 0.100 to 0.110 inches.

* * * * *